US009309729B2

(12) United States Patent
Sjursaether

(10) Patent No.: US 9,309,729 B2
(45) Date of Patent: Apr. 12, 2016

(54) DEVICE AND METHOD FOR CLAMPING A TOP DRIVE SAVER SUB

(75) Inventor: Audun Sjursaether, Bergen (NO)

(73) Assignee: Quality Technical Group AS, Kristiansand (NO)

( * ) Notice: Subject to any disclaimer, the term of this patent is extended or adjusted under 35 U.S.C. 154(b) by 597 days.

(21) Appl. No.: 13/810,171

(22) PCT Filed: Jul. 14, 2011

(86) PCT No.: PCT/NO2011/000201
§ 371 (c)(1),
(2), (4) Date: Feb. 22, 2013

(87) PCT Pub. No.: WO2012/008849
PCT Pub. Date: Jan. 19, 2012

(65) Prior Publication Data

US 2013/0161025 A1 Jun. 27, 2013

(30) Foreign Application Priority Data

Jul. 16, 2010 (NO) ..... 20101016

(51) Int. Cl.
*E21B 19/16* (2006.01)

(52) U.S. Cl.
CPC ..... *E21B 19/16* (2013.01)

(58) Field of Classification Search
CPC ..... E21B 19/00; E21B 19/16; E21B 19/163; E21B 33/038
See application file for complete search history.

(56) References Cited

U.S. PATENT DOCUMENTS

| | | | | |
|---|---|---|---|---|
| 4,759,239 | A | 7/1988 | Hamilton et al. | |
| 6,276,450 | B1 | 8/2001 | Seneviratne | |
| 7,367,402 | B1 * | 5/2008 | Bangert | E21B 19/163 166/377 |
| 2008/0307929 | A1 * | 12/2008 | Lorger | B25B 13/5016 81/57.33 |

FOREIGN PATENT DOCUMENTS

| | | | |
|---|---|---|---|
| EP | 0 286 302 | A2 | 10/1988 |
| WO | 2006/059910 | A1 | 6/2006 |

OTHER PUBLICATIONS

International Search Report for parent application PCT/NO2011/000201, having a mailing date of Nov. 2, 2011.
Written Opinion for parent application PCT/NO2011/000201, having a mailing date of Nov. 2, 2011.
Applicant's Response of Jan. 12, 2012 to Written Opinion for parent application PCT/NO2011/000201, having a mailing date of Nov. 2, 2011.
Preliminary Report for parent application PCT/NO2011/000201, having a completion date of May 25, 2012.

* cited by examiner

*Primary Examiner* — Robert E Fuller
*Assistant Examiner* — David Carroll
(74) *Attorney, Agent, or Firm* — Andrus Intellectual Property Law, LLP

(57) ABSTRACT

A tool is for clamping a saver sub assembly of the drive shaft of a top drive drilling machine, in which a tong, which is arranged to fixedly hold the saver sub assembly by releasable abutment against a portion of the saver sub assembly, is arranged on an upper portion of a frame which, in a position of use, is rotationally rigidly fixed to and projects from a support, the frame being provided with a through-going center opening arranged to receive a substantial portion of the saver sub assembly. A method of replacing a saver sub assembly on the drive shaft of a top drive drilling machine is described as well.

10 Claims, 2 Drawing Sheets

DEVICE AND METHOD FOR CLAMPING A TOP DRIVE SAVER SUB

CROSS-REFERENCE TO RELATED APPLICATIONS

This application is the U.S. national stage application of International Application No. PCT/NO2011/000201, filed Jul. 14, 2011, which International application was published on Jan. 19, 2012 as International Publication No. WO 2012/008849 A1 in the English language, and which application is incorporated herein by reference. The International application claims priority of Norwegian Patent Application No. 20101016, filed Jul. 16, 2010, which application is incorporated herein by reference.

BACKGROUND

There is described a tool for clamping a saver sub assembly of the drive shaft of a top drive drilling machine, characterized more particularly by a tong, which is arranged to hold the saver sub assembly fixed by releasable abutment against a portion of the saver sub assembly, being arranged on an upper portion of a frame which, in a position of use, is attached in a rotationally rigid manner to and projects from a support, the frame being provided with a through-going centre opening arranged to receive a substantial portion of the saver sub assembly. A method of replacing a saver sub assembly on the drive shaft of a top drive drilling machine is described as well.

When a top drive drilling machine is used, for example in exploration and production drilling for oil and gas, one or more subs with varying functions is/are arranged between the drive shaft and the drill string. A sub may work solely as a replaceable wear part for the threads of the drive shaft not to be ruined by constantly being connected and disconnected. Such a sub may remain connected to the drive shaft until it must be replaced because of wear. Another type of sub may include safety valves for controlling the fluid pressure in the drill string, typically one or more so-called IBOPs (Internal Blowout Preventers). Such a sub must be demounted regularly for necessary valve inspection. Because of adjacent elements, for example frame details, ordinary pipe tongs that are used to connect and disconnect pipe sections have a range that makes it impossible to use them to demount and mount said subs, as the drilling machine will abut on the tong before the tong jaw encircles the sub. To demount or mount subs of this kind it is therefore usual to position provisionally a separate rig tong around the sub by means of a lifting tackle and a stack of pallets, for example. This work entails a great risk of personnel injury, and the operation is time-consuming and therefore expensive, as the drilling will have to be stopped for this period.

SUMMARY

The invention has for its object to remedy or reduce at least one of the drawbacks of the prior art, or at least provide a useful alternative to the prior art.

The object is achieved through features which are specified in the description below and in the claims that follow.

An apparatus arranged to be fixed at a drilling floor, preferably to a lockable rotary table, is provided, a pipe tong being attached to an upper portion of a rotationally rigid frame projecting up from a base provided with means arranged to fix the apparatus to the drilling floor. The frame includes a through-going centre opening which is arranged to receive a saver sub assembly and which is provided, at a lower portion, with an abutment arranged to support the saver sub assembly. The frame is preferably tubular. Advantageously, the frame extends through the base, a portion projecting downwards being arranged to extend through an opening in the drilling floor, for example down through a centre opening in the rotary table.

The pipe tong, which is preferably hydraulically operated, is provided with replaceable jaws for adaptation to different types of subs.

The abutment which is arranged in the lower portion of the centre opening is preferably adjustable, so that the distance up to the pipe tong can be adjusted for optimum adaptation to the length of the saver sub assembly which is to be demounted/mounted. Advantageously, the abutment is dampingly attached within the frame, so that it will yield when the saver sub assembly hits the abutment.

In a first aspect, the invention relates more specifically to a tool for clamping a saver sub assembly of the drive shaft of a top drive drilling machine, in which a tong, which is arranged to hold the saver sub assembly fixed by releasable abutment against a portion of the saver sub assembly, is arranged on an upper portion of a frame which, in a position of use, is rotationally rigidly attached to and projects up from a support, the frame being provided with a through-going centre opening arranged to receive a substantial portion of the saver sub assembly, the centre opening, in the position of use of the frame, extending through an opening in the support, characterized in that, in its longitudinal direction and remotely from the tong, the centre opening is limited by a bottom abutment.

The tong may be arranged to releasably abut against a first sub which forms an upper end portion of the saver sub assembly in a position of use, and is arranged to be directly connected to the drive shaft of the drilling machine. Thereby all the elements forming the saver sub assembly may be removed and the tool may be brought into abutment against a portion suited the best possible for the purpose, without any projecting or vulnerable portions like those found on an IBOP, for example.

The bottom abutment may be dampingly connected within the frame by means of one or more shock absorbers. Thereby the strains on the tool as the saver sub assembly is inserted into the centre opening and as the saver sub assembly is released from the tong are reduced.

The frame may include a base arranged to be releasably attached to a rotary table arranged in a drilling floor. The tool may thereby be used without modification of the support.

The tong may be provided with several hydraulically movable, replaceable jaws encircling a centre opening. The tool may thereby easily be adjusted to different types of sub assemblies.

In a second aspect, the invention relates more specifically to a method of replacing a saver sub assembly on the drive shaft of a top drive drilling machine, the method including the following steps:

a) fixing a tool in accordance with the above description to a support, the vertically arranged centre axis of the tool being inside the work range of the drilling machine;
b) lowering the drilling machine until a substantial portion of the saver sub assembly has been inserted into a centre opening in the tool;
c) moving a tong into fixing abutment against a portion of the saver sub assembly;
d) rotating the drive shaft of the drilling machine until the connection between the saver sub assembly and drive shaft has ceased to exist;
e) pulling the drilling machine away from the tool; and f) disengaging the tong from the saver sub assembly and removing the saver sub assembly from the tool, characterized in that the method includes the further step of:

a1) before insertion of the saver sub assembly into the centre opening of the tool, adjusting a bottom abutment according to the axial length of the saver sub assembly.

The tong may be moved into fixing abutment against a first sub which forms an upper end portion of the saver sub assembly in a position of use and is arranged to be connected directly to the drive shaft of the drilling machine. Thereby the entire saver sub assembly may be broken loose, and the tong may be brought to abut against a suitable portion of the saver sub assembly.

The method may further include:

g) preparing a second saver sub assembly;

h) reversing the operations specified under items a)-f) above.

The drilling machine may thereby be prepared again without the tool being changed.

DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
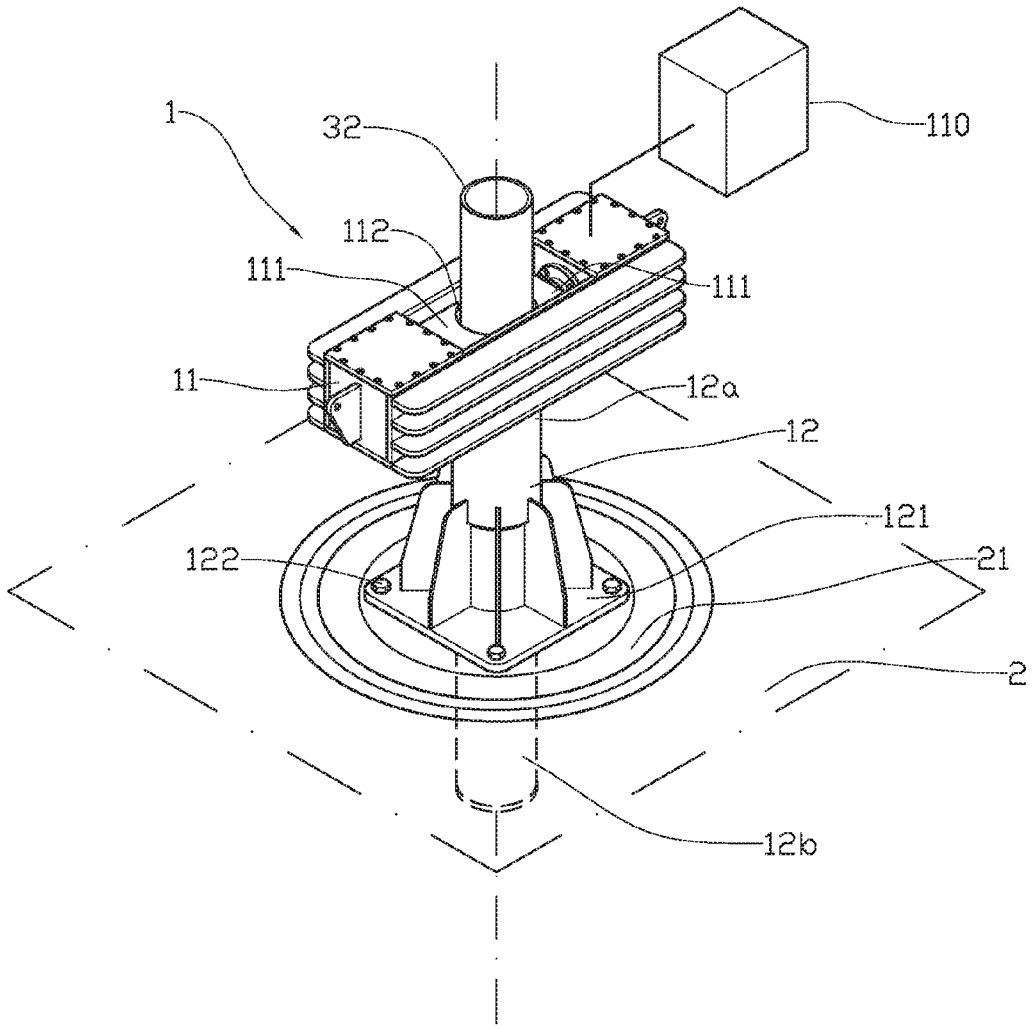
FIG. 1 shows, in perspective, a tool according to the invention arranged on the rotary table of a drilling floor.

In the figures, the reference numeral 1 indicates a tool in accordance with the invention. A support for the tool 1 in an operative position is formed of a drilling floor 2, and a top drive drilling machine 3 is displaceably arranged in a rig (not shown) extending up from the drilling floor 2.

The drilling floor 2 is provided with a rotary table 21, known per se, with a centre opening 211.

The drilling machine 3 is provided with a drive shaft 31 with an end portion projecting downwards arranged for releasable connection to a saver sub assembly 32. In the example shown, the saver sub assembly 32 includes a first intermediate sub 321, first and second internal blowout preventers (IBOPs) 322, 323, and a wear sub 324, but the saver sub assembly 32, which remains connected to the drilling machine 3 during the repeated connecting of pipe sections (not shown) to a drill string (not shown), possibly repeated breaking out of pipe sections (not shown) from a drill string (not shown), may exhibit a wide variety of designs. Said first intermediate sub 321 and wear sub 324 have as their main purpose to provide reasonable, easily replaceable components that save threaded portions of the drive shaft 31 and IBOPs 322, 323 from strong wear and tear due to frequent make-ups and break-outs.

The tool 1 is provided with a hydraulically operated tong 11 provided with several jaws 111 arranged around a centre opening 112. In an operative state, the tong 11 is connected to a hydraulic installation 110. The tong 11 is attached to an upper portion 12*a* of an elongated frame 12 with a through-going centre opening 123, in which, in an operative state, a centre axis is arranged perpendicularly to the support 2. In the exemplary embodiment shown, the frame 12 is formed as a pipe, but a wide range of embodiments that provide a form that will give sufficient support for the tong 11 and hold the loosened saver sub assembly 32 in position can be used.

The frame 12 is provided with a base 121 which includes attachment means 122 arranged to be engaged in a rotationally rigid way with a portion at an opening in the support 2, typically around the centre opening 211 of the rotary table 21.

The frame 12 extends, by a lower end portion 12*b*, through the base 121, the lower end portion 12*b* extending downwards in the opening 211 in the support 2 in an operative state. In that way, during use, the tool will have a moderate overall height above the support 2, considering that, in a normal embodiment, the tool 1 will have a height of about 800 mm up to the lower edge of the tong 11 and that the frame 12 extends about 700 mm downwards from the base 121.

Figure 2:
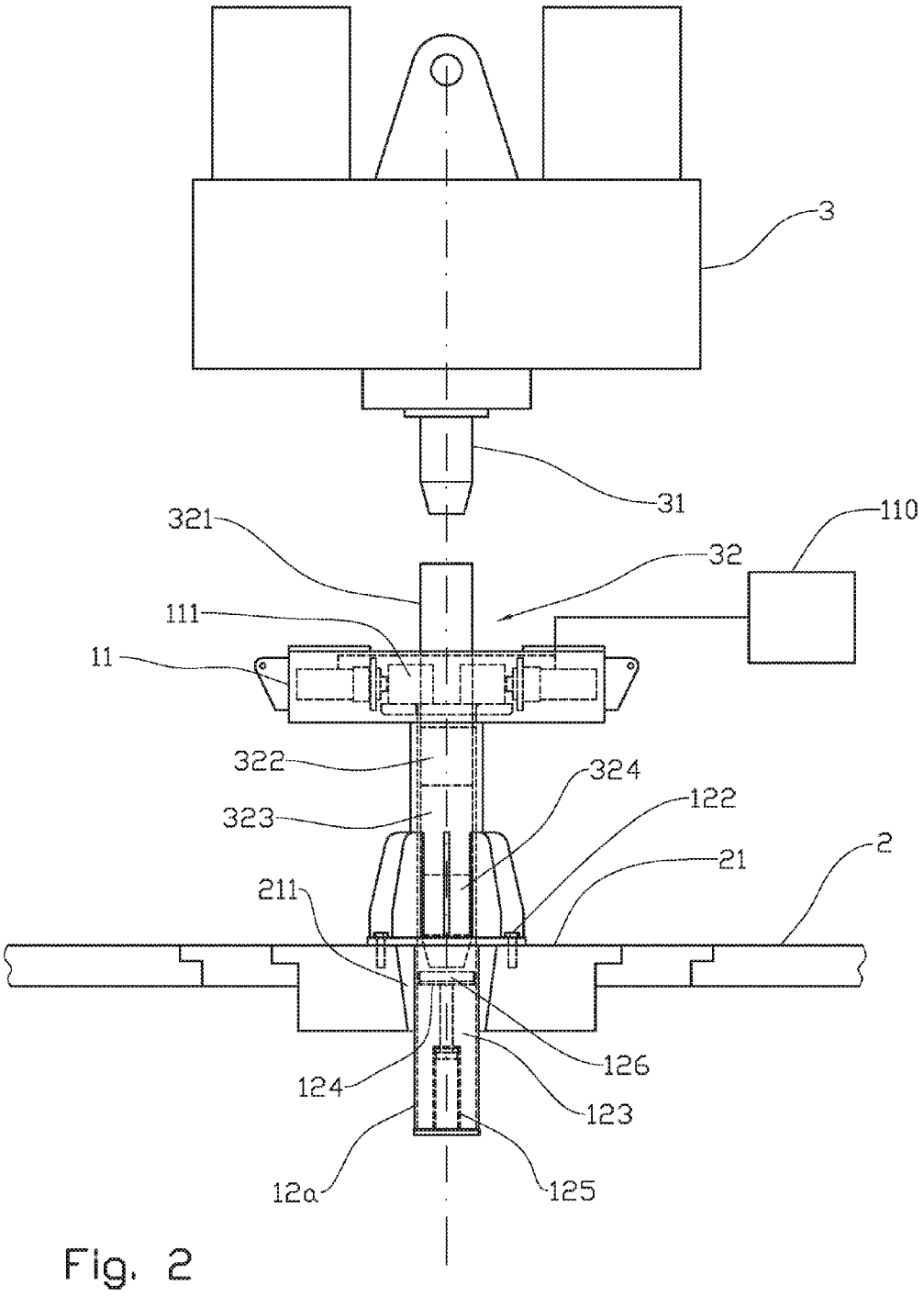
FIG. 2 shows, in a side view, a principle drawing of the tool and a top drive drilling machine.

In the centre opening 123, an abutment 124, which is arranged to support the saver sub assembly 32 such as shown at 126, when this has been disengaged from the drive shaft 31 and the tong 11, is arranged in the lower frame portion 12 *b*. The abutment 124 is adjustable in the longitudinal direction of the centre opening 123, and the abutment 124 is dampingly connected relative to and within the frame 12 for yieldable movement therein by at least one conventional shock absorber 125 adapted such that strains on the tool during use are reduced. As seen in FIG. 2, the abutment 124 is positioned within the centre opening 123 at an upper end of the shock absorber 125 for engaging and supporting a lowermost end of the saver sub assembly 32.

When a saver sub assembly 32 is to be disconnected from the drilling machine 3, the drilling machine 3 with the saver sub assembly 32 is first disconnected from the drill string (not shown), possibly together with other units (not shown) which are loosened in an ordinary manner known per se.

The bottom abutment 124 of the tool 1 is adjusted according to the length of the saver sub assembly 32. The tool 1 is connected to the rotary table 21, and the rotary motion of the rotary table 21 is locked. The drilling machine 3 is moved in such a way that the saver sub assembly 32 is moved down through the centre opening 112 of the tong 11 and into the centre opening 123 of the frame until a suitable portion of the saver sub assembly 32, typically the first intermediate sub 321, is surrounded by the tong 11. The jaws 111 are moved into abutment against the saver sub assembly 32, and the drilling machine 3 is set into rotation with a sufficiently high torque for the connection between the drive shaft 31 and the saver sub assembly 32 to be broken up. The drilling machine 3 is moved away from the tool 1, and the jaws 111 are pulled away from the saver sub assembly 32 so that this is released and rests on the bottom abutment 124 until it is removed from the tool 1.

A checked saver sub assembly 32 is placed in the tool 1 and clamped in the tong 11. The series of operations described above is reversed so that the drilling machine 3 is made ready for new drilling operations with the saver sub assembly 32 mounted on the drive shaft 31. After the drilling machine 3 and the saver sub assembly 32 have been pulled away from the tool 1, the tool 1 is removed from the support 2 and the drilling operation is resumed as the drilling machine 3 is connected to the drill string (not shown).

The invention claimed is:

1. A tool for clamping a saver sub assembly adapted for releasable connection with the drive shaft of a top drive drilling machine, the tool comprising: a tong arranged to hold the saver sub assembly fixed by releasable abutment against a portion of the saver sub assembly, wherein the tool is arranged on an upper portion of a frame which, in a position of use, is rotationally rigidly fixed to and projects from a support, the frame being provided with a through-going center opening arranged to receive a substantial portion of the saver sub assembly, wherein, in the position of use, the frame, extends through an opening in the support such that a lower portion of the frame extends beneath the support, wherein, in a longitudinal direction and remotely from the tong, a bottom abutment is positioned within the center opening in the lower portion of the frame, and configured for engaging and supporting a lowermost end of the saver sub assembly upon release thereof from the drive shaft.

2. The tool in accordance with claim 1, wherein the tong is arranged to releasably abut against a first intermediate sub which forms an upper end portion of the saver sub assembly in a position of use, and the first intermediate sub is adapted to be directly connected to the drive shaft of the drilling machine.

3. The tool in accordance with claim 1, wherein the bottom abutment is yieldable in the longitudinal direction of the center opening upon engagement of the saver sub assembly with the bottom abutment.

4. The tool in accordance with claim 1, wherein the bottom abutment is dampingly connected within the frame by one or more shock absorbers adapted such that strains on the tool during use are reduced.

5. The tool in accordance with claim 1, wherein the frame includes a base arranged to be fixed in a releasable manner to a rotary table arranged in a drilling floor.

6. The tool in accordance with claim 1, wherein the tong is provided with several movable, jaws surrounding a center opening and adapted to be moved by a hydraulic installation and replaced as desired.

7. A method of replacing a saver sub assembly on the drive shaft of a top drive drilling machine, the method comprising:

a) fixing a tool to a support, a vertically arranged center axis of the tool being inside the work range of the drilling machine;

b) positioning a bottom abutment within a center opening of the tool;

c) lowering the drilling machine until a substantial portion of the saver sub assembly has been inserted into the center opening in the tool such that the saver sub assembly engages and is supported by the bottom abutment;

d) moving a tong into fixing abutment against a portion of the saver sub assembly;

e) rotating the drive shaft of the drilling machine until the connection between the saver sub assembly and drive shaft has ceased to exist;

f) pulling the drilling machine away from the tool; and g) disengaging the tong from the saver sub assembly and removing the saver sub assembly from the tool.

8. The method in accordance with claim 7, wherein the tong is moved into fixing abutment against a first intermediate sub which forms an upper end portion of the saver sub assembly in a position of use, and is adapted to be directly connected to the drive shaft of the drilling machine.

9. The method in accordance with claim 7, wherein the method further comprises:

g) preparing a second saver sub assembly;

h) reversing the operations specified under items a)-f) above.

10. A tool for clamping a saver sub assembly adapted for releasable connection with the drive shaft of a top drive drilling machine, the tool comprising: a tong arranged to hold the saver sub assembly fixed by releasable abutment against a portion of the saver sub assembly, wherein the tool is arranged on an upper portion of a frame which, in a position of use, is rotationally rigidly fixed to and projects from a support, the frame being provided with a through-going center opening arranged to receive a substantial portion of the saver sub assembly, wherein, in the position of use, the frame extends through an opening in the support such that a lower portion of the frame extends beneath the support, wherein, in a longitudinal direction and remotely from the tong, a bottom abutment, wherein the bottom abutment is dampingly connected within the frame by one or more shock absorbers adapted such that strains on the tool during use are reduced.

* * * * *